US006449811B1

(12) United States Patent
Tokugawa

(10) Patent No.: US 6,449,811 B1
(45) Date of Patent: Sep. 17, 2002

(54) SEAT BELT DEVICE

(75) Inventor: Osamu Tokugawa, Fujisawa (JP)

(73) Assignee: NSK Autoliv Co., Ltd., Tokyo (JP)

( * ) Notice: Subject to any disclaimer, the term of this patent is extended or adjusted under 35 U.S.C. 154(b) by 62 days.

(21) Appl. No.: 09/636,028

(22) Filed: Aug. 11, 2000

(30) Foreign Application Priority Data

Sep. 6, 1999 (JP) ..... 11-251486

(51) Int. Cl.[7] ..... A44B 11/26
(52) U.S. Cl. ..... 24/198
(58) Field of Search ..... 24/801.1, 808, 24/801.2, 198, 200, 323, 312; 297/483, 468

(56) References Cited

U.S. PATENT DOCUMENTS 3,982,769 A * 9/1976 Farlind
4,023,826 A * 5/1977 Kokubo et al.

FOREIGN PATENT DOCUMENTS

JP 52-151532 11/1977
JP 63-38057 2/1988
JP 2-24147 1/1992
JP 5-112199 5/1993
JP 6-42466 6/1994
JP 7-304416 11/1995
JP 8-207703 8/1996

* cited by examiner

*Primary Examiner*—James R. Brittain
(74) *Attorney, Agent, or Firm*—Crowell & Moring LLP

(57) ABSTRACT

In a seat belt device which restrains an occupant to a seat, a tongue plate includes a belt through portion in which a webbing pass-through opening which allows a webbing to pass therethrough is formed and an engaging portion which is engaged with a buckle, and the shape of the webbing pass-through opening includes a straight line portion which is linear in the webbing width direction and has an approximately constant width in the webbing thickness direction and first and second bent portions which have the approximately same width as the width of the straight line portion and respectively extend in the oblique direction from both ends of the straight line portion toward a buckle engaging portion side.

11 Claims, 6 Drawing Sheets

SEAT BELT DEVICE

BACKGROUND OF THE INVENTION

1. Field of the Invention

The present invention relates to a seat belt device for use in restraining an occupant of a vehicle thus securing the safety against a traffic accident, and more particularly to an improvement of a tongue plate of a seat belt device.

2. Description of the Related Art

A tongue plate which allows the webbing to pass therethrough is engaged with a buckle, thereby fastening of the seat belt is effected. Examples of such a tongue plate are illustrated in Japanese Utility Model Laid-open Publications 151532/1977 and 42466/1994.

In an example illustrated in Japanese Utility Model Laid-open Publication 151532/1977, a webbing pass-through opening is constituted by an elongated hole which is formed linearly in the webbing width direction and both end portions of the elongated hole are formed of circular holes having a large curvature. Further, in an example illustrated in Japanese Utility Model Laid-open Publication 42466/1994, projecting portions are respectively formed on both end peripheries of a webbing and convex-shaped holes which correspond to the projecting portions are formed in both end portions of a webbing pass-through opening of a tongue plate. Due to such constitution, respective projecting portions formed on both end portions of the webbing are held in these two convex-shaped holes formed in the tongue plates thus preventing the twisting of the webbing.

However, when the circular holes having a large diameter are formed in both ends of the webbing pass-through opening as disclosed in Japanese Utility Model Laid-open Publication 151532/1977, there exists a possibility that the twisting of the webbing occurs. Further, when the convex-shaped holes formed in both ends of the webbing pass-through opening are directed toward the folding side of the webbing as disclosed in Japanese Utility Model Laid-open Publication 42466/1994, contact border lines with the tongue plate are defined slightly inside from both ends of the webbing in the width direction so that the peripheries of the webbing are worn. Particularly, when a fuse belt which can reduce a large load applied to an occupant at the time of collision is provided to a portion of the webbing in the vicinity of a webbing anchor plate, there arises a problem with respect to a manner to reduce the wear. To prevent the wear of both peripheral portions of the webbing, a method which increases the webbing pass-through opening in the webbing width direction may be considered. However, this method gives rise to the increase of the width of the overall tongue plate and the increase of the weight of the tongue plate and hence, the method is not preferable. Further, since the offset load is applied to the tongue plate, this method necessitates the reinforcement of the tongue plate to prevent the lowering of its strength. The reduction of the weight of the tongue plate, however small the reduction amount may be, is a matter to be taken into account for enhancing the winding characteristics of a retractor at the time of releasing the tongue plate.

SUMMARY OF THE INVENTION

Accordingly, it is an object of the present invention to provide a seat belt device which uses a tongue plate which can prevent its shape from becoming large-sized and can substantially prevent the occurrence of the twisting of a webbing and the wear of the peripheries of the webbing.

The above-mentioned object of the present invention can be achieved by a seat belt device which comprises a webbing which restrains an occupant to a seat, a tongue plate which allows the webbing to pass therethrough, a buckle which is positioned in the vicinity of a waist of the occupant and is engaged with the tongue plate, wherein the tongue plate includes a belt through portion in which a webbing pass-through opening which allows the webbing to pass therethrough is formed and an engaging portion which is engaged with the buckle, and the webbing pass-through opening includes a straight line portion which is linear in the webbing width direction and has an approximately constant width in the webbing thickness direction and first and second bent portions which have the approximately same width as that of the straight line portion and respectively extend in the oblique direction from both ends of the straight line portion toward a buckle engaging portion side.

Further, the above-mentioned object of the present invention can be also achieved by a seat belt device which is provided with a tongue plate to be engaged with a buckle, wherein the tongue plate comprises a first portion in which an opening to be engaged with the buckle is formed, a second portion which is offset by a given amount relative to the first portion in the thickness direction of the tongue plate and a connecting portion which connects the first portion and the second portion and in which a webbing pass-through opening is formed, and the webbing pass-through opening comprises a straight line portion which extends approximately linearly in the webbing width direction and a pair of bent portions which extend from both ends of the straight line portion toward the opening side to be engaged with the buckle.

Due to such constitution, when the webbing pass-through opening of the tongue plate which extends in the webbing width direction is comprised of the straight line portion and the bent portions which are raised toward the opening side from both ends of the straight line portion and the webbing is made to extend through the webbing pass-through opening in a slidable manner in the folded-back condition at a certain angle $\alpha$ (see FIG. 4), since the peripheral portions of the webbing are moved along the bent portions of the webbing pass-through opening which extended in the direction opposing the folding-back direction of the webbing, no strong force is applied to the peripheries of the webbing and hence, the generation of the wear to the peripheral portions of the webbing can be suppressed. Further, by making the width of the webbing pass-through opening in the webbing thickness direction approximately constant, the occurrence of the passing through of the webbing in a twisted form (and the turn-over of the tongue plate which may follow thereafter) can be prevented.

The length of the straight line portion of the webbing pass-through opening may preferably be approximately equal to or greater than the dimension of the webbing width.

Due to such constitution, when the webbing is not applied to the occupant, both ends of the webbing in the webbing width direction are not substantially brought into contact with the bent portions. Accordingly, the resistance which is generated when the webbing slides through the webbing pass-through opening of the tongue plate in the seat belt fastening step can be minimized and hence, the deterioration of the manipulating feeling in the belt fastening operation can be prevented.

Further, the overall dimension of the webbing pass-through opening in the webbing width direction is preferably set to a value which is greater than the width of the webbing and not more than the webbing width+6 mm.

Due to such a constitution, the deviation of the webbing can be prevented and an amount of offset load applied to the buckle in the webbing fastened condition can be reduced.

DETAILED DESCRIPTION OF THE PREFERRED EMBODIMENTS

Embodiments of the present invention are explained hereinafter in conjunction with attached drawings.

Figure 1:
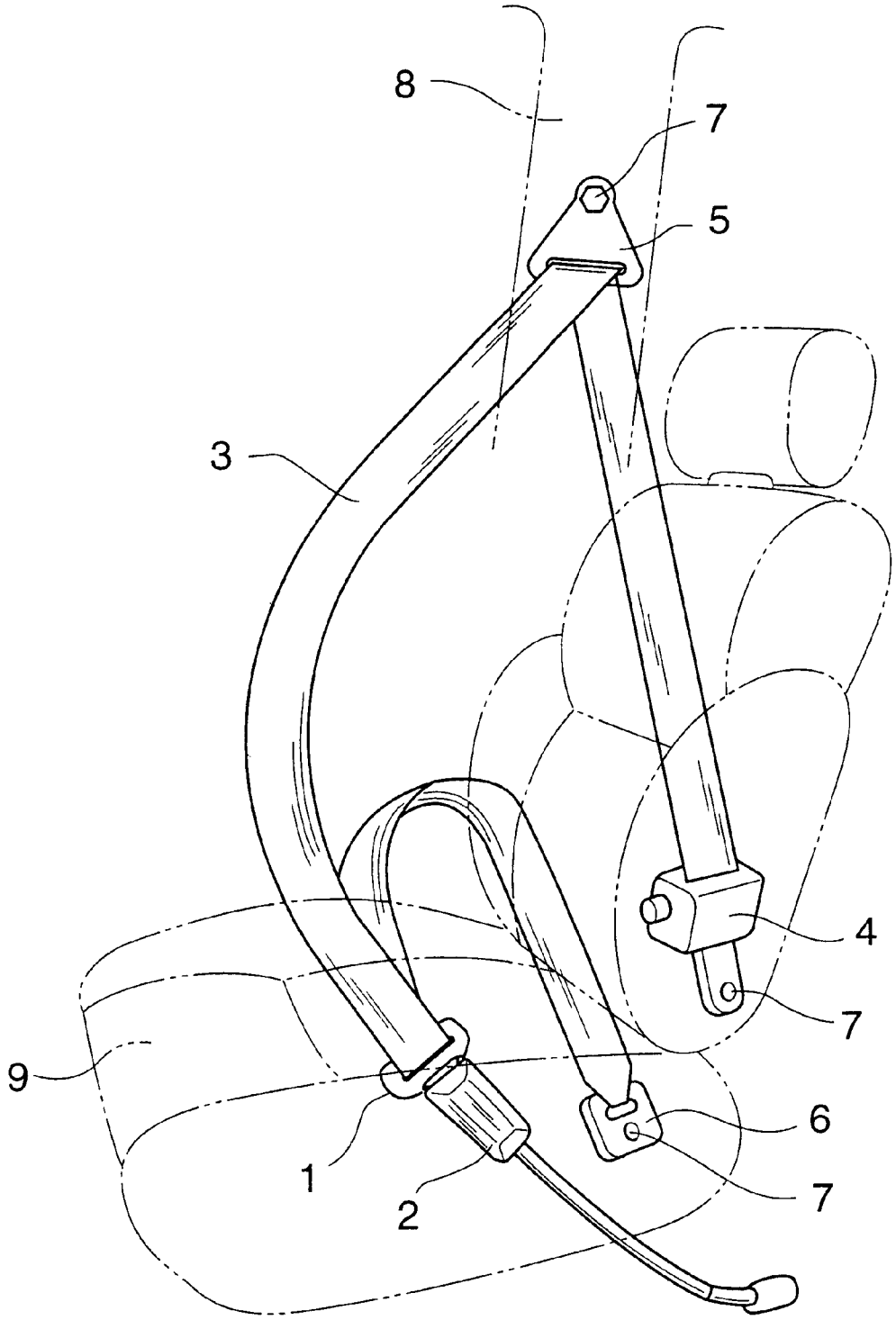
FIG. 1 is a perspective view for explaining a seat belt device of the first embodiment of the present invention.

As shown in FIG. 1, on a floor surface side of a vehicle body, a winding device (a retractor) 4 which winds a webbing 3 is mounted by means of a bolt 7. One end of the webbing 3 is connected to the retractor 4 so that, in the normal operation, the retractor 4 is capable of winding the webbing 3 into the retractor 4 or pulling out the webbing 3 from the retractor 4. The other end of the webbing 3 is folded back toward a lower side of the vehicle body by way of a webbing pass-through opening of a through anchor 5 which is rotatably mounted on an upper side of a center pillar 8 by means of a bolt 7 and then is attached to an anchor plate 6 which is rotatably mounted on the floor surface side of the vehicle body by means of a bolt 7. A tongue plate 1 is mounted on the webbing 3 between the through anchor 5 and the anchor plate 6. By allowing the webbing 3 to pass through a webbing pass-through opening of the tongue plate 1, the tongue plate 1 is movable in the longitudinal direction along the webbing 3. By engaging the tongue plate 1 with a buckle 2 which is disposed in the vicinity of a waist of an occupant(not shown in the drawings) sitting on a seat 9, a seat belt can be fastened. Further, by carrying out the releasing manipulation at the buckle 2, the seat belt can be removed.

Figure 2:
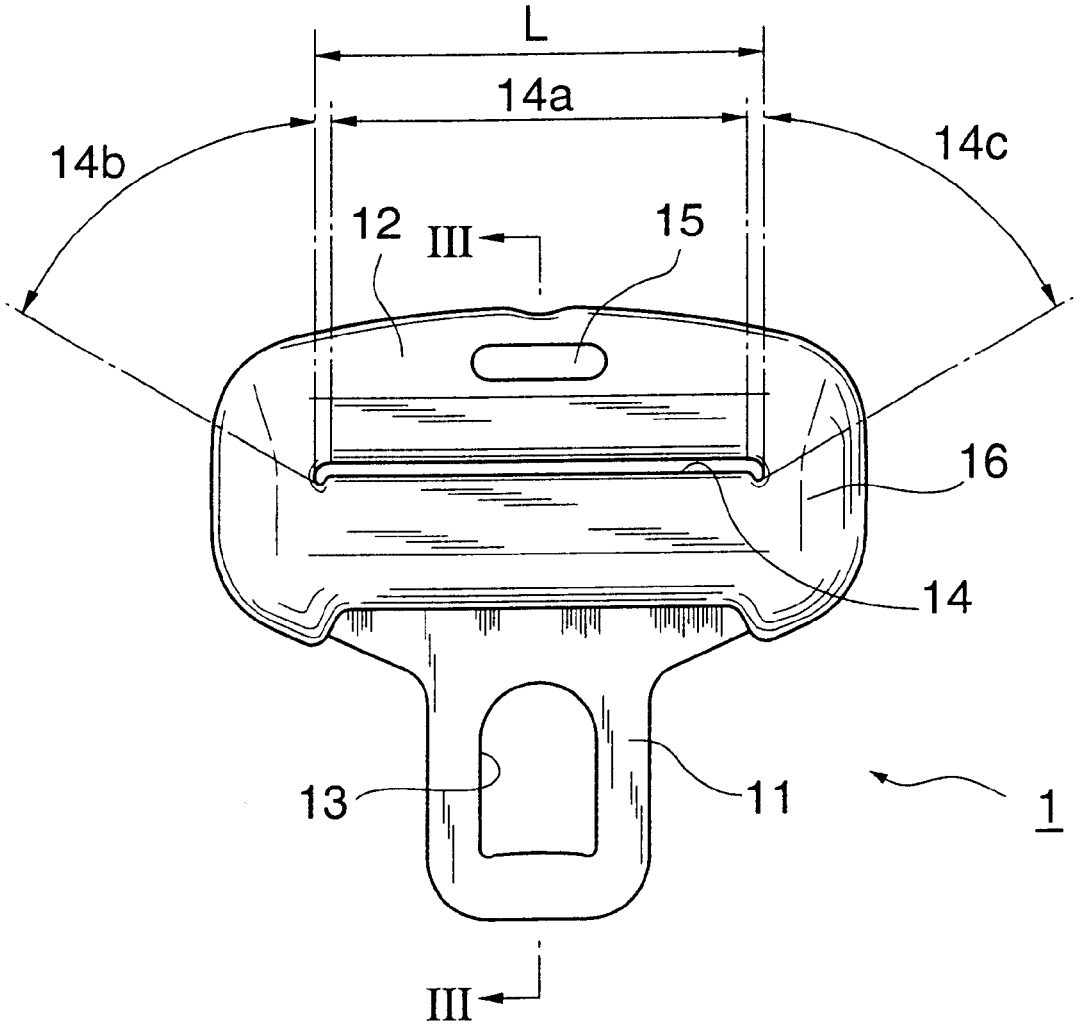
FIG. 2 is a plan view of a tongue plate according to the first embodiment of the present invention.
Figure 3:
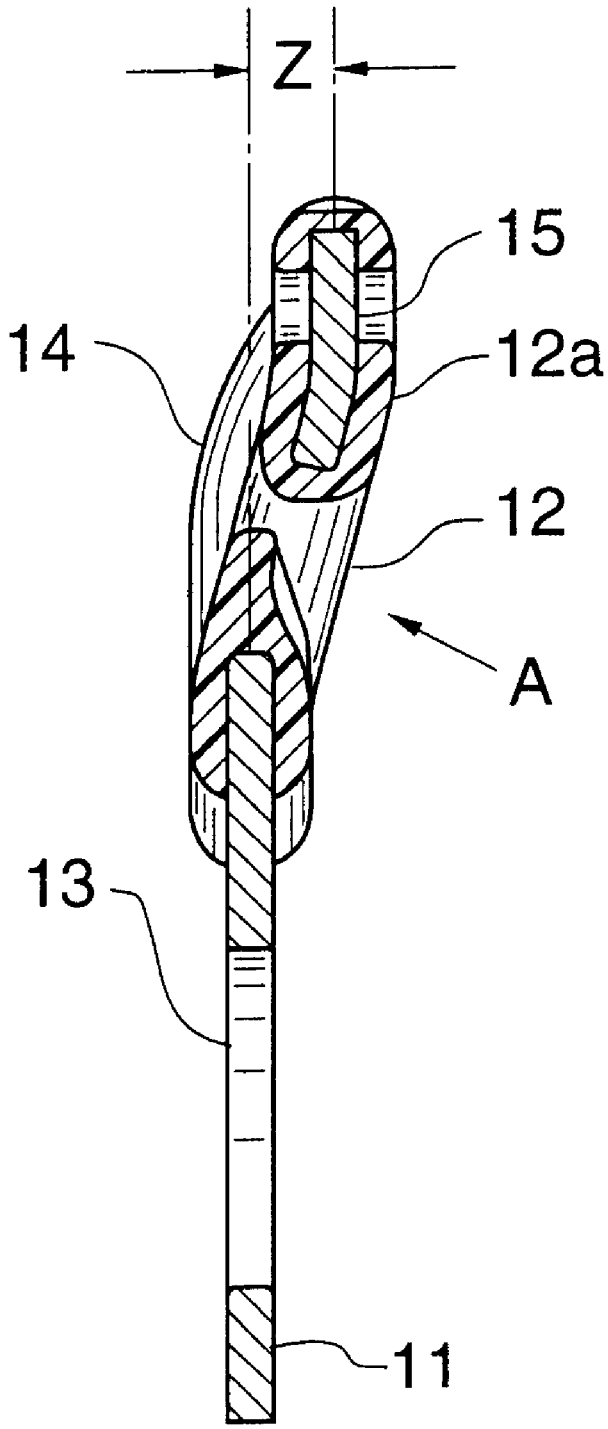
FIG. 3 is a cross-sectional view of the tongue plate taken along a line III—III of FIG. 2.

As shown in FIG. 2 and FIG. 3, the tongue plate 1 has an approximately "T" shape and includes an engaging portion (a first portion) 11 which defines a protruding portion of that shape and is engaged with the buckle 2, a retaining portion 15 (a second portion) which retains the folded-back webbing 3, and a connecting portion 16 which connects the engaging portion 11 and the retaining portion 15. The retaining portion 15 is offset relative to the engaging portion 11 by a given amount (a dimension Z in FIG. 3) in the plate thickness direction of the tongue plate 1. Further, the webbing pass-through opening 14 which allows the passing of the webbing 3 therethrough is formed in the connecting portion 16. A belt through portion 12 is constituted by the retaining portion 15 and the connecting portion 16. The engaging portion 11 is made from a metal, for example, iron, while the belt through portion 12 is formed by coating this metal with a resin material, for example, nylon 12*a*. As can be also understood also from FIG. 3, the webbing pass-through opening 14 is formed so as not to injure the webbing. That is, the webbing pass-through opening 14 which is coated with the resin material is rounded along the entire periphery thereof in the cross-sectional direction. An opening 13 which is engaged with a latch piece of the buckle 2 (not shown in the drawings) is formed in the center of the engaging portion 11. The webbing pass-through opening 14 consists of a straight line portion 14*a* and bent portions 14*b*, 14*c* formed at both sides of the straight line portion 14*a*.

Figure 4:
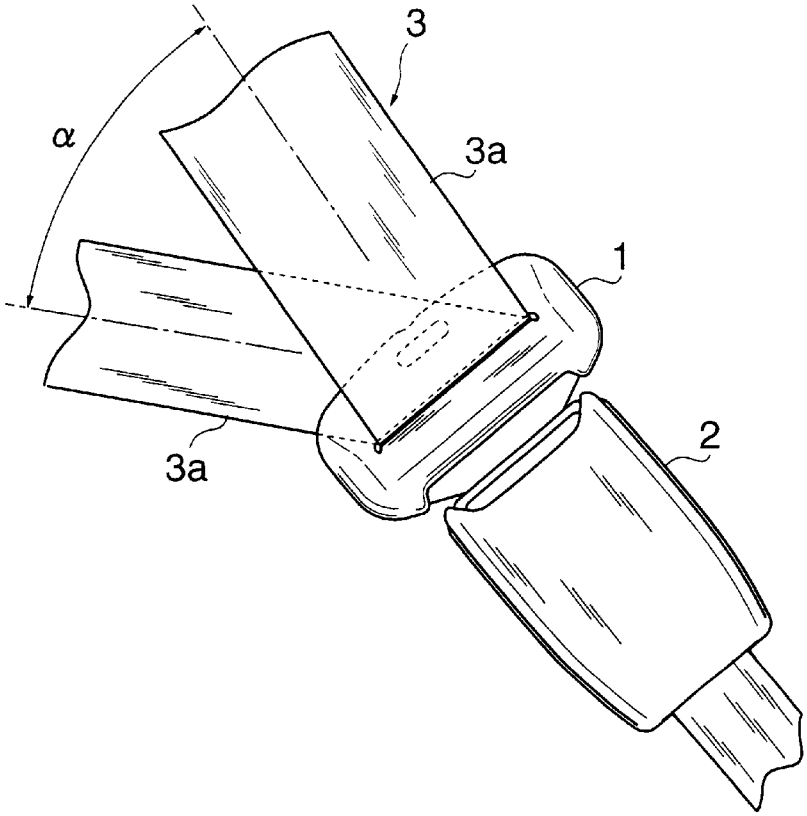
FIG. 4 is an explanatory view for explaining the tongue plate portion at the time of fastening the seat belt.

As shown in FIG. 4, the straight line portion 14*a* of the through opening 14 has a dimension which at least corresponds to the width of the webbing 3. The holes constituting the first and second bent portions (a pair of bent portions) 14*b*, 14*c* are formed such that they extend in the direction toward the engaging portion 11 of the tongue plate 1.

Figure 5:
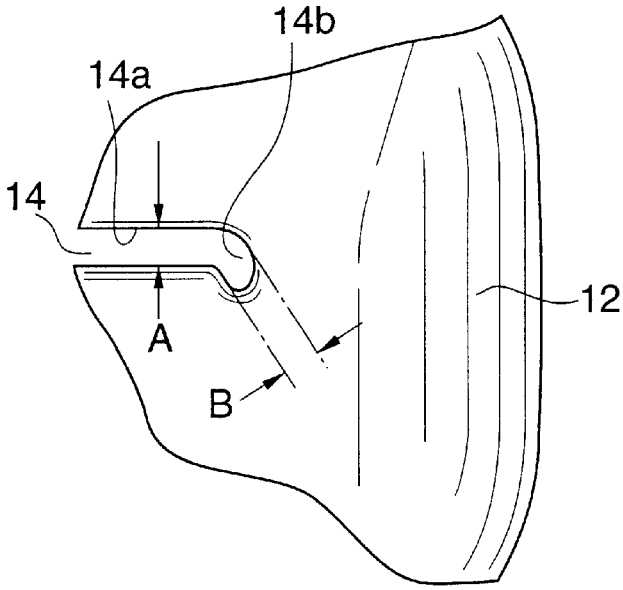
FIG. 5 is a partially enlarged view for explaining an end portion of a webbing pass-through opening of the tongue plate.
Figure 6:
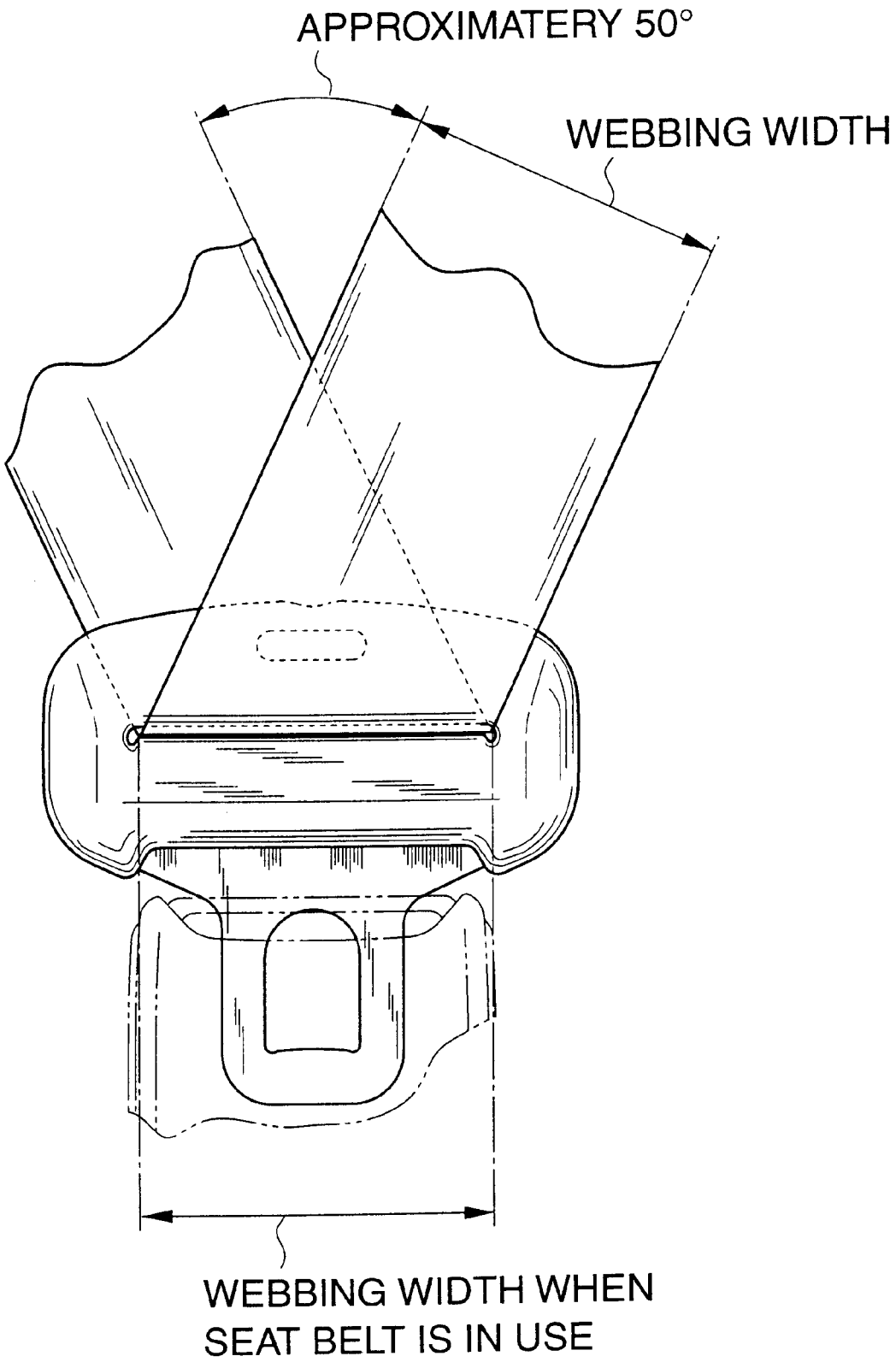
FIG. 6 is an explanatory view for explaining the width dimension of a webbing which is folded back at the time of fastening the seat belt.

Further, as shown in FIG. 5, a dimension of the width of the webbing pass-through opening 14 in the webbing thickness direction (a dimension as seen from an arrow direction A of FIG. 3 (as seen from a direction approximately perpendicular to the connecting portion 16)) is determined such that the width A of the straight line portion 14*a* and the width B of the bent portions 14*b*, 14*c* take an opening width which slightly exceeds the thickness of the webbing 3 and also become approximately equal (A≅B) over the entire region of the opening 14. Further, the straight line portion 14*a* and the bent portions 14*b*, 14*c* are smoothly communicated by way of rounded portions having a given curvature. By forming the through opening 14 in this manner, when the webbing 3 is slidably moved under the condition that the webbing 3 is folded back at an angle of $\alpha$ at the tongue plate 1 (see FIG. 4), the peripheral portions 3*a* of the webbing 3 are moved while riding on and along the bent portions 14*b*, 14*c*. Accordingly, the contact between the peripheral portions 3*a* and a resin mold 12*a* is moderated and hence, the wear of the peripheral portions 3*a* can be reduced.

As mentioned previously, the length of the straight line portion 14*a* of the through opening 14 in the opening extending direction is set to the value approximately equal to or more than the width dimension of the webbing so that the peripheral portions 3*a* of the webbing 3 are substantially prevented from coming into contact with the bent portions 14*b*, 14*c* in the course of fastening operation from the condition that the seat belt is not yet fastened to the condition that the seat belt is fastened. Accordingly, increase of the friction which occurs at the time when the webbing slidably moves through the tongue plate 1 can be prevented until the seat belt is fastened. Further, the webbing pass-through opening 14 is formed such that the dimension of the webbing pass-through opening 14 in the webbing thickness direction is set to a dimension which slightly exceeds the thickness of the webbing 3 and takes an approximately constant value (see FIG. 5) over the entire region of the straight line portion 14*a* and the bent portions 14*b*, 14*c*. Accordingly, it becomes possible to prevent the webbing 3 from passing through the webbing pass-through opening 14 in the twisted form.

Further, it is desirable that the overall width L of the webbing pass-through opening 14 in the webbing width direction is restricted to a value equal to or below a dimension produced by adding 6 mm to the webbing width. In the normal operation, the belt opening angle α at the through opening portion of the tongue plate 1 at the time of fastening the seat belt becomes approximately 50 degrees and the webbing width is widened by approximately 6 mm. Accordingly, to use the webbing 3 in the proper folding back condition and to obtain the advantageous effects of the present invention, it is desirable to restrict the adding width to a value equal to or less than 6 mm. By restricting the overall width of the pass-through opening 14 to the value equal to or less than "the webbing width+6 mm", the deviation of the webbing 3 relative to the tongue plate 1 can be suppressed while ensuring the proper folding back of the webbing so that the increase of the offset load applied to the tongue plate 1 can be suppressed. Accordingly, the offset load applied to a buckle body 2 can be also suppressed. Therefore, the reinforcement of the mechanical strength of the tongue plate 1 which must be performed considering the offset load becomes no more necessary.

Figure 7:
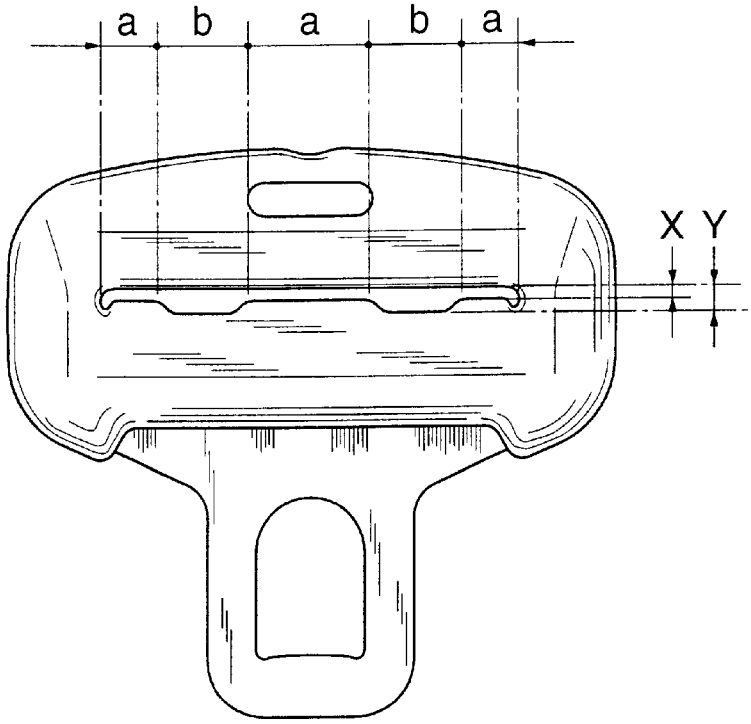
FIG. 7 is a plan view of a tongue plate of the second embodiment of the present invention which is provided with wide and narrow zones in a webbing pass-through opening, wherein three narrow zones and two wide zones are formed.
Figure 8:
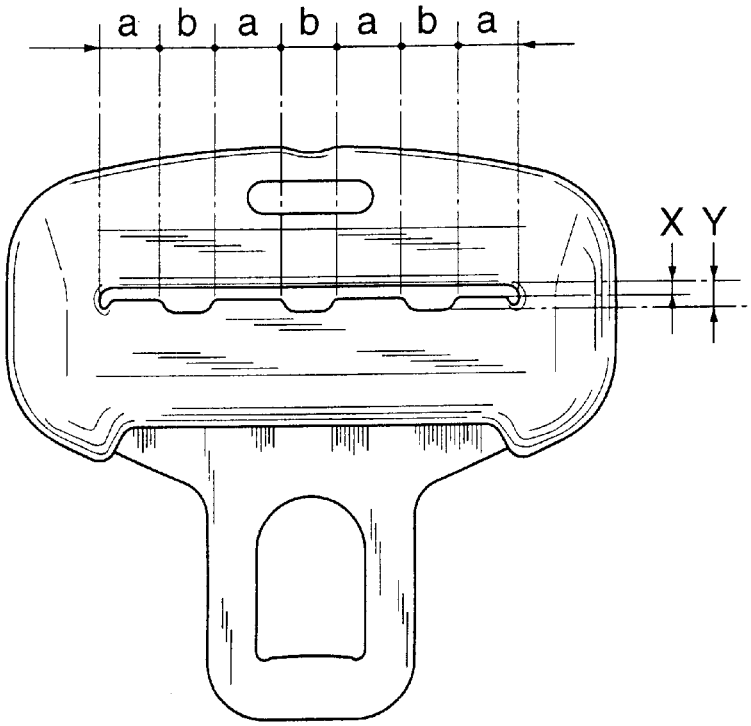
FIG. 8 is a plan view of a tongue plate of the third embodiment of the present invention which is provided with wide and narrow zones in a webbing pass-through opening, wherein four narrow zones and three wide zones are formed.

FIG. 7 and FIG. 8 show the second and third embodiments of the present invention. Compared to the first embodiment shown in FIG. 2, in respective embodiments, the webbing pass-through opening has narrow zones a and wide zones b in the thickness direction, wherein the narrow zones a have a dimension X which is slightly greater than the thickness of the webbing as in the case of the first embodiment and the wide zones b have a dimension Y which exceeds the dimension X of the narrow zones a. In FIG. 7, the narrow zones a are composed of three zones which are disposed at both ends and at the center of the webbing pass-through opening in the webbing extending direction. In FIG. 8, the narrow zones a are composed of four zones, wherein two zones a are disposed at respective ends of the webbing pass-through opening in the webbing extending direction and other two zones a are disposed at an approximately central portion of the webbing pass-through opening symmetrically in the left and right direction. The wide zones b are extended in the webbing thickness direction as well as toward the engaging portion side, wherein two wide zones b are formed in FIG. 7 and three wide zones b are formed in FIG. 8.

Due to such constitutions, since the dimension in the thickness direction and the shape of the webbing pass-through portion at both ends and the approximately center thereof in the extending direction can be formed in the same manner as those of the first embodiment, the similar advantageous effects can be obtained by the second and third embodiments. That is, "the approximately constant width of the webbing pass-through opening in the thickness direction" means not only the constitution shown in FIG. 2 but also the constitutions shown in FIG. 7 and FIG. 8. The dimension of the narrow zones a of the webbing pass-through opening in the extending direction should be determined such that when the webbing is deviated to one side of the webbing pass-through opening, the other end of the webbing is not overlapped with the wide zone b. That is, the dimension of the narrow zones a of the webbing pass-through opening in the extending direction should be a dimension which prevents the seat belt from passing through the webbing pass-through opening in a twisted form. Further, the dimension and the largeness of the respective wide zones may be different from each other and the number of the wide zones is not limited to the numbers shown in the embodiments.

As has been described heretofore, according to the constitutions of embodiments of the present invention, the webbing pass-through opening 14 of the tongue plate 1 is constituted by the straight line portion 14*a* and the bent portions 14*b*, 14*c* which are inclined toward the engaging portion side and the length of the straight line portion 14*a* is set to the value approximately equal to or more than the width of the webbing 3. Accordingly, the wear produced by rubbing of the peripheral portions 3*a* of the webbing can be reduced without deteriorating the manipulation feeling in the seat belt fastening operation. Further, the entanglement of the webbing to the tongue plate at the time of fastening the seat belt caused by the wear and the deterioration of the feeling of fastening which is produced when the worn portion where fibers are made coarse touches the skin of the occupant can be prevented.

Further, in the embodiments, by making the dimension of the webbing pass-through opening 14 in the webbing thickness direction slightly greater than the thickness of the webbing and making the dimension of the webbing pass-through opening 14 constant in the opening extending direction, the twisting of the webbing relative to the tongue plate can be prevented. Further, by restricting the overall dimension L of the webbing pass-through opening in the webbing width direction to the value equal to or less than a given value, the offset load applied to the tongue plate can be suppressed so that it is no more necessary to provide an excessive reinforcement to the tongue plate thus realizing the compacting of the tongue plate and the reduction of the weight of the tongue plate.

What is claimed is:

1. A seat belt device comprising:

a webbing which restrains an occupant to a seat;

a tongue plate which allows the webbing to pass therethrough;

a buckle which is positioned in the vicinity of a waist of the occupant and is engaged with the tongue plate;

wherein the tongue plate includes a belt through portion in which a webbing pass-through opening which allows the webbing to pass therethrough is formed and an engaging portion which is engaged with the buckle; and the webbing pass-through opening includes a straight line portion which is linear in the webbing width direction and has an approximately constant width in the webbing thickness direction and first and second bent portions which have the approximately same width as the width of the straight line portion and respectively extend in the oblique direction from both ends of the straight line portion toward a buckle engaging portion side such that upon fastening the webbing, peripheral portions of the webbing are allowed to move while riding on and along the first and second bent portions, respectively.

2. A seat belt device according to claim 1, wherein the length of the straight line portion of the webbing pass-through opening is set to a value approximately equal to or more than the dimension of the webbing width.

3. A seat belt device according to claim 1, wherein the straight line portion and the first and second bent portions of said webbing pass-through opening are smoothly communicated with each other.

4. A seat belt device according to claim 1, wherein the overall width of the webbing pass-through opening in the webbing width direction is set to a value equal to or less than the webbing width+6 mm.

5. A seat belt device according to claim 1, wherein the straight line portion of the webbing pass-through opening has narrow zones and wide zones in the webbing thickness direction.

6. A seat belt device according to claim 5, wherein the narrow zones are formed such that when the webbing is deviated to one side of the webbing pass-through opening, the other end of the webbing is overlapped with the narrow zone.

7. A seat belt device being provided with a tongue plate to be engaged with a buckle, wherein the tongue plate comprises:

a first portion in which an opening to be engaged with the buckle is formed;

a second portion which is offset by a given amount relative to the first portion in the thickness direction of the tongue plate; and a connecting portion which connects the first portion and the second portion and in which a webbing pass-through opening is formed; and the webbing pass-through opening comprises:

a straight line portion which extends approximately linearly in the webbing width direction; and a pair of bent portions which extend from both ends of the straight line portion toward the first portion.

8. A seat belt device according to claim 7, wherein the first portion and the second portion extend approximately parallel to each other.

9. A seat belt device according to claim 7, wherein the width of the webbing pass-through opening in the webbing thickness direction is made approximately constant in the longitudinal direction of the webbing pass-through opening.

10. A seat belt device according to claim 7, wherein the length of the straight line portion of the webbing pass-through opening is set to a value approximately equal to or more than the dimension of the webbing width.

11. A seat belt device according to claim 7, wherein the straight line portion and the bent portions of the webbing pass-through opening are smoothly communicated with each other.

* * * * *